United States Patent [19]

Hoetzl et al.

[11] Patent Number: 5,074,782

[45] **Date of Patent: * Dec. 24, 1991**

[54] INDUSTRIAL FURNACE WITH IMPROVED HEAT TRANSFER

[75] Inventors: Max Hoetzl, Toledo, Ohio; Thomas M. Lingle, Temperance, Mich.

[73] Assignee: Surface Combustion, Inc., Maumee, Ohio

[ * ] Notice: The portion of the term of this patent subsequent to Oct. 16, 2007 has been disclaimed.

[21] Appl. No.: 572,679

[22] Filed: Aug. 27, 1990

Related U.S. Application Data

[63] Continuation-in-part of Ser. No. 425,686, Oct. 23, 1989, Pat. No. 4,963,091.

[51] Int. Cl.[5] ..... F27B 3/22

[52] U.S. Cl. ..... 432/176; 432/152; 432/250; 432/209; 126/21 A

[58] Field of Search ..... 432/176, 152, 144, 146, 432/199, 206, 209, 250

[56] References Cited

U.S. PATENT DOCUMENTS

| | | | |
|---|---|---|---|
| 3,091,445 | 5/1963 | Toney | 432/176 |
| 3,620,513 | 11/1971 | Wernicke | 432/176 |
| 3,905,760 | 9/1975 | Johansson et al. | 432/176 |
| 4,094,631 | 6/1978 | Grieve | 432/176 |
| 4,395,233 | 7/1983 | Smith et al. | 432/176 |
| 4,516,012 | 5/1985 | Smith et al. | 432/176 |
| 4,648,377 | 3/1987 | Van Camp | 126/21 A |
| 4,722,683 | 2/1988 | Royer | 432/176 |
| 4,789,333 | 12/1988 | Hemsath | 432/176 |
| 4,813,398 | 3/1989 | Savage | 432/176 |
| 4,836,776 | 6/1989 | Jomain | 432/176 |
| 4,854,860 | 8/1989 | Hemsath | 432/21 |
| 4,854,863 | 8/1989 | Hemsath | 432/176 |
| 4,867,132 | 9/1989 | Yencha | 126/21 A |
| 4,963,091 | 10/1990 | Hoetzl et al. | 432/176 |

*Primary Examiner*—Henry C. Yuen

*Attorney, Agent, or Firm*—Body, Vickers & Daniels

[57] ABSTRACT

An improved industrial furnace employing a new and unique heat transfer arrangement is disclosed. The furnace is a closed end cylindrical chamber with a circular, concentrically positioned plate dividing one side of the furnace into a fan chamber containing a fan and the other side of the furnace into a heat treat chamber containing the work. The plate has a central under-pressure opening and its outer circular edge is spaced from the cylindrical wall to define an annular space which is non-orificing. Fan rotation in the fan chamber produces an annulus of wind mass swirling at high circumferential speed which axially travels through the non-orificing space towards the closed end of the heat treat chamber at slow speed. Heating elements extend through the non-orificing space into the heat transfer chamber and are constantly impinged by the swirling annulus wind mass to effect good heat transfer therewith. The under-pressure opening causes the heated wind to contact the work before it is drawn into the under-pressure opening for recirculation. An incineration track is provided in the furnace insulation for incinerating the furnace flue products while also heating the wind mass.

5 Claims, 5 Drawing Sheets

INDUSTRIAL FURNACE WITH IMPROVED HEAT TRANSFER

This invention is a continuation-in-part of application Ser. No. 425,686 filed Oct. 23, 1989, and entitled "Method and Apparatus for Effecting Convective Heat Transfer in a Cylindrical, Industrial Heat Treat Furnace", U.S. Pat. No. 4,963,091.

This invention relates generally to the industrial furnace field and more particularly to a heat transfer arrangement to at least partially heat and cool the work in a furnace which has universal application.

INCORPORATION BY REFERENCE

The parent application, Ser. No. 425,686 filed Oct. 23, 1989, now U.S. Pat. No. 4,963,091, entitled "Method and Apparatus for Effecting Convective Heat Transfer in a Cylindrical, Industrial Heat Treat Furnace" is hereby incorporated by reference herein and made an integral part hereof.

BACKGROUND OF THE INVENTION

In the heat treat field, metal work is to be heated and cooled in accordance with known, time-temperature-atmosphere composition heat treat processes. Simplistically, the work is heated, held and cooled at specific rates and times while the gaseous or furnace atmosphere surrounding the work is controlled to impart desired metallurgical and mechanical properties to the work.

In the furnace art, cooling of the work (except for furnace cool heat treat processes) always occurs by convection, while heating by convection is typically limited to low temperature furnace applications, about a maximum of 1400° F. Convective heat transfer is typically accomplished in batch furnaces by either baffle arrangements which divert and direct the flow of furnace atmosphere about the work or, alternatively, by high speed jets which are used to impinge the work to establish high heat transfer rates. All baffle arrangements require adjustment and are thus "sensitive" to performing different processes on different furnace loads. In addition, the cost to construct the baffles is expensive. Jet nozzle arrangements are generally used only for cooling the work and are specifically designed as a predetermined nozzle configuration for impinging cooled atmosphere against a specific workpiece shape or are of a general configuration which directs multiple streams of jets against the work. In either instance, separate longitudinally-extending plenum chambers are built within the furnace to develop high pressure jets or alternatively an external heat exchanger is used which then pumps the cooled air into a plenum or manifold distributor within the furnace. This is also an expensive furnace construction.

There are, however, numerous, convective heat transfer arrangements in the prior art and it is known to use the intake of a fan as a centrally positioned under-pressure zone to establish closed loop, pump type recirculation schemes in the sense that atmosphere is drawn into the fan, pressurized by the fan in a plenum chamber and then directed through a manifold to impinge the work. A variation of this theme is disclosed in U.S. Pat. No. 4,789,333 to Hemsath (incorporated herein by reference) where a free-standing, longitudinally moving circular jet is developed through an orifice and expanded into turbulent contact with a cylindrical shell member as the jet travels the length of a cylindrical shell. At the end of the shell, the high speed jet is redirected by a special diverter plate to impinge the work and after impingement the atmosphere is collected through the under-pressure zone to be pressurized again into a jet. This arrangement is limited to the thin shell furnace of the '333 patent which can be placed into heat transfer contact with a high velocity jet travelling along its length. U.S. Pat. No. 4,395,233 to Smith et al (incorporated herein by reference) illustrates the use of a central under-pressure zone to cause recirculation of flat sheets of forced air in a baking oven by causing the forced air to assume a torroidal shape as it travels to the fan under-pressure zone. However, Smith's oven is rectilinear in configuration and Smith uses the same prior art concept of pressurizing the wind in a plenum chamber which is directed from the plenum chamber through rectangular slots which orifice the forced air into his oven. None of the recirculation arrangements is sufficient to develop the "wind" pattern required in the heat treat furnace applications to which the present invention is concerned.

Also, it often occurs that the work, when heated, emits toxic gases or fumes. For example, powdered or sintered metal parts when heated, even at low temperatures, emit smoke which contains hydrocarbons and require separate afterburners or incinerators to burn the hydrocarbons and other pollutants which increases furnace cost. Heat is typically recovered from the incinerators through heat exchanges and typically used to heat boilers or preheat the combustion air used in the furnace burners. This is inefficient because heat must first be developed to incinerate the volatiles and the recovery of the heat is limited to secondary processes.

Apart from specific furnace design considerations, in general, furnace construction is typically divided between low temperature and high temperature applications. As indicated previously, heat transfer efficiencies dictate that low temperature furnaces be heated by convection while high temperature furnaces heat the work by radiation although convection/radiation heat transfer is employed to heat the work through the lower temperature ranges. For high temperature applications, the furnace construction is further divided between those furnaces which operate at slight positive pressure, or standard atmosphere furnaces, and those furnaces which operate under vacuum such as vacuum furnaces, ion "glow discharge" furnaces, etc. Traditionally, high and low temperature, positive pressure, batch furnaces were typically distinguished in their construction by the type of insulation used in the furnace. Low temperature applications in many instances use an "oven" panel construction where low grade insulation is simply sandwiched between metal skins to form panels which are welded together to form a box into which a burner is placed. In contrast, high temperature, standard atmosphere furnaces typically were constructed about a steel liner or casing to which refractory was bricked. With improvements in ceramic, fibrous furnace insulation which replaced refractory brick linings, the physical distinctions between the two furnace constructions began to dissipate although the low temperature furnace, because of insulation prices, remains a low cost furnace while high temperature applications use a more expensive insulation construction technique. Finally, certain metallurgical processes require that the heat treating gas be diffused into the case of a heated metal part under a vacuum. Typically, vacuum furnace constructions use a double wall or double casing construction which is spherically or cylindrically shaped to withstand collapse when a vacuum is pulled therein and water is typically circulated between the walls to provide a cold wall design so that the furnace door can have an elastomer seal to vacuum seal the enclosure. Insulation is provided on the inside of the inner casing. There are, however, heat treat applications which fall short of the high vacuum levels that would demand a double walled, vacuum vessel construction.

While a high temperature furnace can be used to perform either high or low temperature heat treat processes, the use of a high temperature furnace to perform low temperature heat treat processes is not cost effective to the heat treater. Further, it is not cost effective to the heat treater to use a vacuum furnace to perform a high temperature heat treat process such as carburizing when the carburized case tolerances are such that the process could be performed in a standard atmosphere, high temperature batch furnace. Basically, the furnace throughput coupled with furnace cost dictate the heat treater's charge and heretofore precluded small heat treaters who did not have a range of furnaces from competing with large heat treaters who could afford to purchase a number of different furnaces to perform different heat treat processes.

SUMMARY OF THE INVENTION

Accordingly, it is a principal object of the invention to overcome the difficulties of the prior art noted above by providing a system, arrangement, method and/or apparatus for improved heat transfer within an industrial furnace.

This object along with other features of the invention is achieved in an industrial furnace for effecting heat treat processes on metal work disposed therein which includes a cylindrical, insulated furnace section with a sealable door at one axial end of the casing and an end plate at the opposite axial end thereof to define a closed end cylindrical chamber therein. A circular fan plate centrally positioned within the chamber divides the chamber into a fan chamber extending between the circular plate and the end plate and a heat treat chamber extending between the circular plate and the door. Importantly, the circular plate defines an annular space which is non-orificing and which extends between the circular plate's outer diametrical edge and the interior or inside surface of the cylindrical furnace section to provide fluid communication between the fan chamber and the heat treat chamber The plate also has a centrally positioned under-pressure opening which extends therethrough to also provide fluid communication between the heat treat chamber and the fan chamber. A heat transfer arrangement in the form of a plurality of circumferentially spaced, tubular elements longitudinally extend from the end plate through the fan chamber, through the annular space and into the heat treat chamber The tubular elements provide a temperature source which is initially different than the temperature of the work within the heat treat chamber. A fan centrally positioned within the fan chamber directs the furnace atmosphere as a wind mass in a direction perpendicular to the longitudinal center of the chamber and normal to the cylindrical furnace section and swirling with a high circumferential velocity about the interior of the cylindrical furnace section. The wind mass gradually moves longitudinally through the non-orificing space toward the door end to effect rapid heat transfer by circumferential velocity impingement with the tubular elements. The under-pressure opening causes the wind mass after heat transfer contact with the work in the heat transfer chamber to return to the fan chamber.

In accordance with another aspect of the invention, the tubular elements include a first plurality of tubular heating elements and a second plurality of cooling tubes. The first plurality of heating elements are heated to a temperature which is initially hotter than the temperature of the work. A coolant is provided to the interior of the second plurality of cooling tubes for cooling the second plurality of cooling tubes to a temperature initially colder than the temperature of the work. The first and second plurality of tubular elements are selectively heated and cooled so that the wind mass arrangement described above can be utilized to direct high circumferential velocity flow to effect both improved convective heating and cooling of the work. Significantly, the first plurality of tubular heating elements, by extending within the heat treat chamber at circumferentially spaced increments about the work, provides a uniformly distributed source of radiant heat to the work to achieve uniform high temperature heating of the work required for certain heat treat processes and the convective heat transfer arrangement assures rapid heating of the work at least through the low-end of the temperature range of the heat cycle.

In accordance with another feature of the method of the invention, a paddle bladed fan in the fan chamber develops a wind mass which circumferentially rotates in a non-turbulent manner about the smooth interior surface of the cylindrical furnace section at high velocities. Significantly, the fan does not impart axial force components to the wind mass and the non-orificing annular space prevents axial pressure from developing within the fan chamber so that as the wind mass builds within the fan chamber, the wind gradually travels axially towards the door end of the chamber. The high circumferential velocity of the wind mass directly impacts the tubular heating elements and cooling tubes which are circumferentially spaced and diametrically sized so that the wind mass annulus remains substantially intact. The under-pressure opening establishes a centripetal force tending to gradually strip the inner portion of the wind mass annulus as the wind mass axially travels to the door end of the furnace. However, the circumferential velocity of the wind mass is established at a sufficiently high speed to permit most of the wind mass to swirl in heat transfer contact with the tubular elements until contact with the door end at which time the swirl is broken and the under-pressure zone pulls the now heated or cooled wind past the work into the fan chamber.

In accordance with a significantly important feature of the invention, especially when the furnace is used to heat treat powdered metal or sintered metal parts which emit volatiles or hydrocarbons when heated, the cylindrical furnace section is provided with an incineration track formed as a circumferentially extending groove adjacent to and in heat transfer contact with the interior surface of the cylindrical furnace section. At least a portion of the track is situated to extend longitudinally about a portion of the fan chamber and the track need not circumferentially extend about the entire circumference of the furnace section. The track has an inlet in fluid communication with the fan chamber which receives a portion of the wind mass drawn by the fan into the fan chamber through the under-pressure zone and an outlet extending from the exterior of the cylindrical furnace section for exhausting the furnace atmosphere. A heater is provided for thermally cleaning or incinerating the furnace atmosphere in the incineration track which in turn provides additional heat to the swirling wind mass developed by the fan so that the incineration heat may be directly inputted to the furnace section.

In accordance with yet another feature of the invention, the cylindrical furnace section, the end wall and the sealable door are constructed as a typical steel casing to which a conventional fibrous, high density ceramic insulation is affixed in tight abutting relationship through the chamber so that a vacuum at at least slight negative pressure can be drawn into the chamber. A gas inlet is provided in the cylindrical furnace section in communication with the chamber for purposes of selectively drawing a vacuum in the chamber and/or admitting a furnace atmosphere gas therein so that the furnace can be selectively operated as a draw furnace, or a high temperature furnace or a vacuum furnace.

It is another object of the invention to provide an industrial heat treat furnace with enhanced heat transfer capabilities with a heat source and/or a heat sink.

It is still yet another object of the invention to provide a furnace with improved heat transfer with a heat source and/or heat sink and from the heat source and/or heat sink to the work.

It is still yet another object of the invention to provide a baffle-free and nozzle-free industrial heat treat furnace which can operate as a vacuum furnace with improved convective heat transfer characteristics.

It is still yet another object of the invention to provide an industrial heat treat furnace which can heat treat work at high heat treat temperatures and which can rapidly and uniformly heat the work to the high temperatures.

A still further object of the invention is to provide an economical furnace which can function as either a batch vacuum furnace or a standard atmosphere batch furnace capable of processing work at low or high temperatures.

Still yet another object of the invention is to provide a furnace which can thermally clean, within the furnace, the fumes exhausted therefrom.

Yet another object of the invention is to provide a furnace which incinerates the fumes exhausted therefrom and uses the heat from the incineration to heat the work.

Still another object of the invention is to provide a furnace with internal incineration of the flue gases and which can heat the work in the absence of significant quantities of air so that the furnace can pyrolyze toxic and/or hazardous wastes.

These and other objects and advantages of the invention will become apparent from a reading and understanding of the Detailed Description of the Invention set forth below taken together with the drawings which will be described in the next section.

BRIEF DESCRIPTION OF THE DRAWINGS

The invention may take physical form in certain parts and arrangement of parts, a preferred embodiment of which will be described in detail herein and illustrated in the accompanying drawings which form a part hereof and wherein.

DETAILED DESCRIPTION OF THE INVENTION

Figure 1:
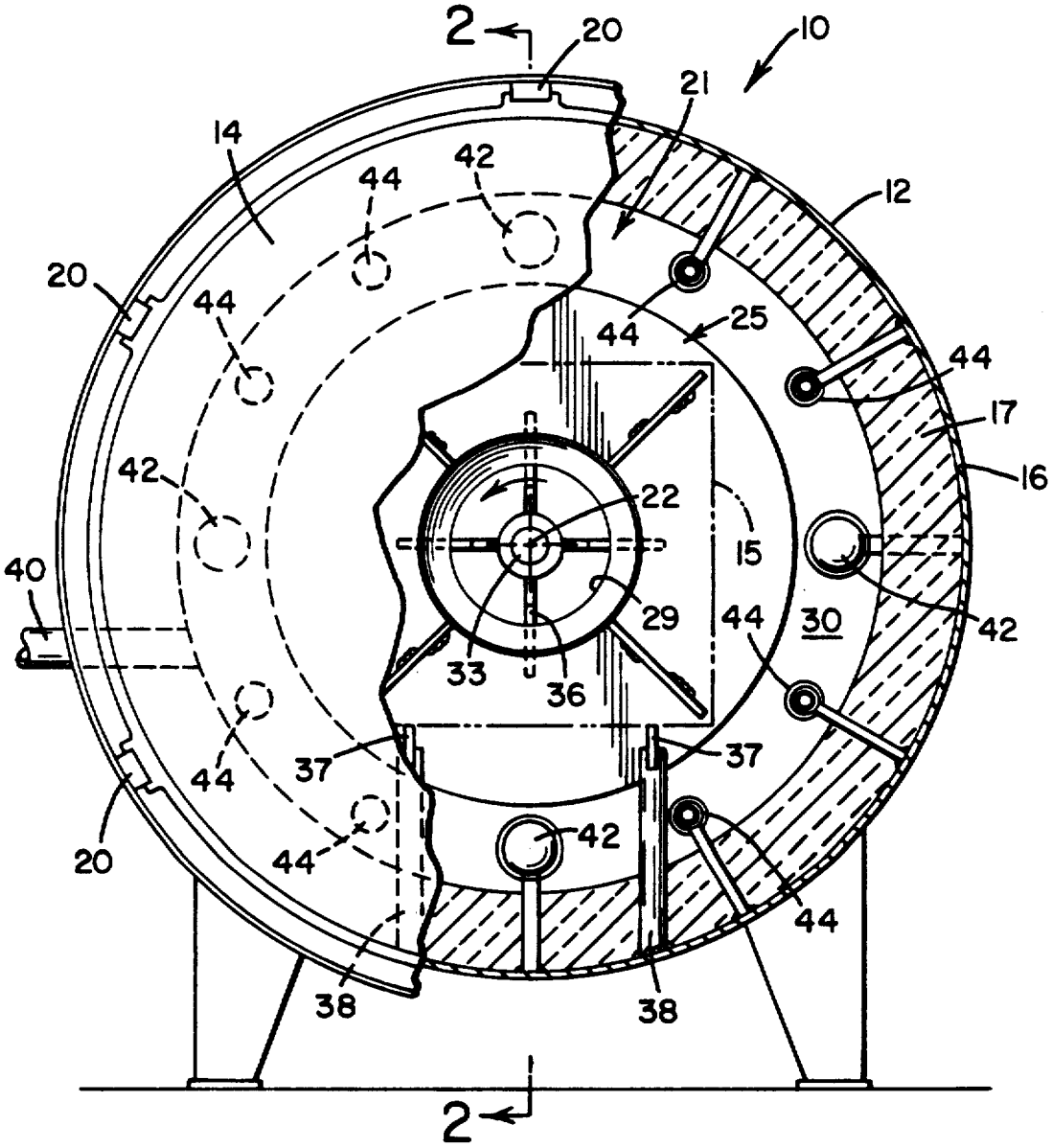
FIG. 1 is a front end elevation view partially broken away of a furnace illustrating concepts of the present invention.
Figure 2:
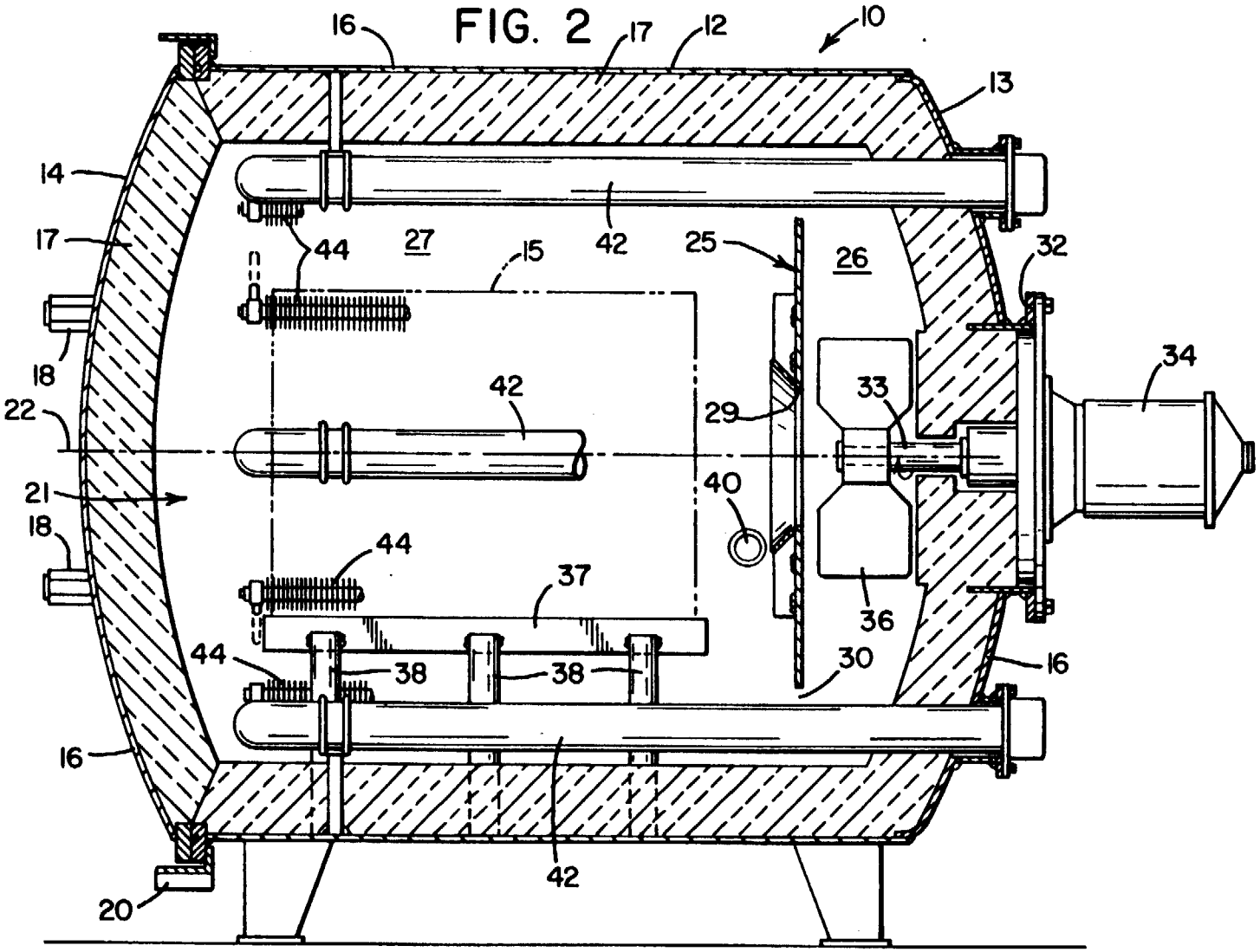
FIG. 2 is a sectioned, side elevation view of the furnace shown in FIG. 1 taken along line 2—2 of FIG. 1.

Referring now to the drawings wherein the showings are for the purpose of illustrating a preferred embodiment of the invention only and not for the purpose of limiting the same, there is shown in FIGS. 1 and 2 a heat treat furnace 10 which will be described as functioning as a vacuum furnace. Furnace 10 comprises a cylindrical furnace section 12 closed at one end by a spherically shaped end furnace section 13 and at its opposite axial end by a spherically shaped sealable door 14 through which work in the form of loose metal parts placed in a tray shown by dot-dash lines 15 is loaded into and out of furnace 10. The furnace sections 12, 13 (and for that matter door 14) comprise standard ⅜" plain carbon steel plate (i.e. 1012) or a casing 16 to which is secured a vacuum-formed ceramic fiber insulation 17 of a relatively high density, i.e. 10–15 lbs./ft$^3$. The surface of the insulation is sprayed with a conventional silica sand mixture, i.e. Kaowool rigidizer, to make it hard and rigid. Insulation 17 is conventional and is secured to casing 16 in a conventional manner which is not shown or described herein in detail. More specifically, insulation 17 is formed into preshaped blocks individually secured to casing 16 by studs extending therefrom and fitted together like pieces of a jigsaw puzzle into tight, compressive contact with one another which when sprayed with the rigidizer prevents gas leakage therethrough. While insulation 17 is conventional, it is to be noted that an inner metal lining is not applied to the face or interior of insulation 17 although a high velocity wind mass flow is developed in furnace 10. The wind mass flow is not turbulent at the exposed surfaces of insulation 17 and this is the reason why interior metal lining plates are not required. Further, it is or should be noted that furnace 10, while capable of functioning as a standard batch type furnace, will be described as a vacuum furnace and that the casing-insulation construction shown is not typical for a vacuum application. There is no water jacket in furnace 10. At the same time, it is to be noted that furnace 10 will not withstand the vacuum levels which a double casing, water Jacket vessel is able to withstand.

A hinge (not shown) on one side of furnace 10 connects to trunnions 18 on door 14 to rotate door 14 from an open to a closed position and a plurality of clamps 20 circumferentially spaced about the outer periphery of door 14 are employed to vacuum seal door 14 to cylindrical furnace section 12. With door 14 sealed, cylindrical furnace section 12, end furnace section 13 and door 14 define a smooth walled closed ended cylindrical chamber 21 symmetrical about the longitudinal centerline 22 of furnace 10.

Concentrically positioned relative to centerline 22 as by fasteners (not shown) secured to end furnace section 13 is a circular fan plate 25. Fan plate 25 divides chamber 22 into a fan chamber 26 defined as axially extending from fan plate 25 to end furnace section 13 while that portion of chamber 21 axially extending from fan plate 25 to door 14 is defined as a heat treat chamber 27. Fan plate 25 has a central under-pressure opening 29 concentric with centerline 22 and which, as described hereafter, produces an under-pressure zone developing a centripetal force tending to collapse the wind mass into heat treat chamber 27 and effective to cause recirculation of the furnace atmosphere. Importantly, the outside diameter of fan plate 25 is sized relative to the inside diameter of cylindrical casing 12 to establish an annular space 30 which has a sufficient radial distance to be non-orificing in nature as will be explained hereafter. In the preferred embodiment, the outside diameter of fan plate 25 is about 52 inches and the inside diameter of cylindrical casing 12 is about 68 inches establishing the radial distance of annular space 30 at about 8". These dimensions are established for a furnace sized to process a work tray 15 having a dimension of 36×48×36". At this dimension and at the circumferential speeds of the wind mass, annular space 30 will not develop a pressure or any significant pressure in fan chamber 26 which could adversely diminish the rotational speed of the swirl or otherwise act to straighten the swirl and in the process thereof impart longitudinal velocity to the swirl. It is for this reason that fan chamber 26 is designated a fan chamber and not a plenum chamber which is conventional in the art.

A fan bung 32 mounted to end casing 13 journals a fan shaft 33 concentrically positioned on centerline 22 driven by an external motor 34. Mounted on fan shaft 33 is a paddle bladed impeller 36. Importantly, a paddle blade 36 is chosen since it directs its wind mass normal to cylindrical casing 12 and perpendicular to centerline 22. There is no axial component of wind mass developed by paddle blades 36.

Within heat treat chamber 27 is a hearth 37 supported by a plurality of longitudinally spaced, vertically extending supports 38 affixed to casing 16 of cylindrical furnace section 12. Hearth 37 supports the work which typically comprise loose metal pieces placed in conventional trays or baskets 15 which may have either open mesh sides or closed sides and which as noted above are all shown by dot-dash lines. As noted above, for the specific furnace 10 illustrated in the drawings, work trays or baskets can have a height of 36 inches, and a length of 48 inches and a width of 36". Those skilled in the art will recognize that furnace 10 is sized by the tray dimension which can fit within the furnace and the tray size quoted for the preferred embodiment is typical. Also within heat treat chamber 27 is a vacuum port or opening 40. A conventional vacuum pump (not shown) and a conventional regulated valve train (also not shown) are connected to port 40. When furnace 10 is operated as an atmosphere furnace or when furnace 10 is operated as a vacuum furnace in its standard atmosphere "mode", the valve train emits an inert gas such as nitrogen into chamber 21 and when furnace 10 is operated as a vacuum furnace an inert gas such as nitrogen is also emitted by the valve train through port 40 with or without hydrogen addition in accordance with conventional practice. It is to be understood that when furnace 10 is operated as a standard atmosphere batch furnace, port 40 will control furnace atmosphere exhaust and regulate furnace pressure in a conventional manner.

Furnace 10 is provided with a heat source and a heat sink. The heat source can take the form of any longitudinally extending tubular heating elements 42 which provides heat, somewhat uniformly, along its length. In furnace 10 shown in FIGS. 1 and 2, tubular heating elements 42 are shown to take the form of a single ended radiant tube which extends through end wall section 13, through fan chamber 26, through non-orificing annular space 30 and into heat treat chamber 27 whereat radiant tube terminates after extending longitudinally within heat treat chamber 27 a distance which is preferably equal to that of work 15. While a radiant tube is illustrated in the drawings, tubular heating elements 42 in practice take the form of tubular, electric rod bundle elements. These are simply carbon or graphite electrodes which generate heat when electric current is applied to the electrode. However, radiant tubes, which are conventionally known in the art and will not be described in further detail herein, can be used with either electric heating elements within the tube or a fuel fired burner firing its products of combustion into the open end of the tube. All tubular heating elements 42 disclosed generate somewhat constant heat output incrementally along this length. In the illustrated furnace 10, there are four radiant tubes 42 which are spaced in equal circumferential increments about non-orificing annular space 30.

The heat sink provided for furnace 10 takes the form of an internal heat exchanger tube 44 which like the radiant tube extends from outside furnace 10 through end wall section 13, through fan chamber 26, through non-orificing annular space 30 and into heat treat chamber 27 where heat exchange tube 44 terminates after extending a longitudinal distance at least equal to that of the length of work 15. These internal heat exchange tubes are available from the assignee of this invention, Surface Combustion, Inc., under the brand name Intra-Kool. Basically, the tubes are pipes through which a coolant such as water is piped when the work is to be cooled and over which hot furnace atmosphere is blown to become cool by contact therewith prior to contacting and cooling work 15. However, the same, improved convective heating concept employed in the present invention for uniquely heating the work can likewise be employed vis-a-vis internal heat exchanger tubes 44 to cool work 15. As best shown in FIG. 1, a plurality of heat exchanger tubes 44 are provided spaced in circumferential increments about an orificing annular space 30 and in between radiant tubes 42. It should be noted that the circumferential spacing between tubes taking into account the four radiant tubes 42 and the eight heat exchanger tubes 44 together is equal. It should be noted that tubular heating elements 42 as well as heat exchanger tubes 44 extend through only end wall section 13 which limits the number of openings which have to be made in casing 16.

FURNACE OPERATION

Figure 3:
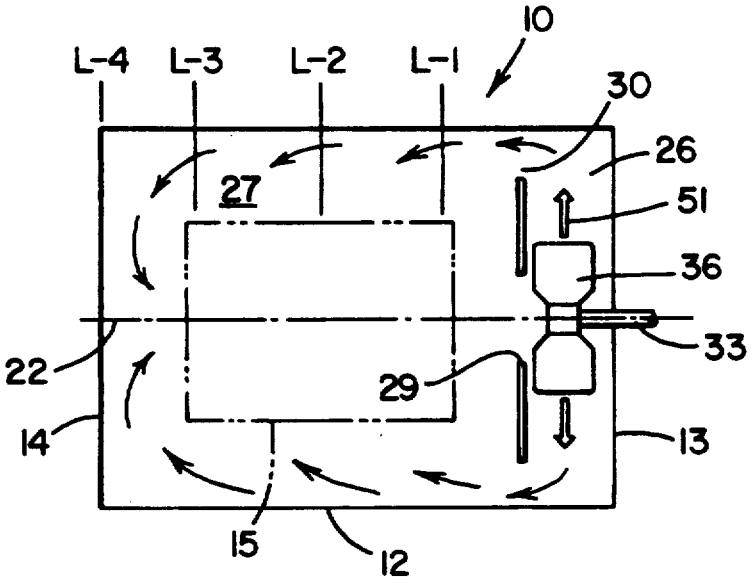
FIG. 3 is a schematic side elevation view schematically illustrating the wind mass developed in the present invention.
Figure 4:
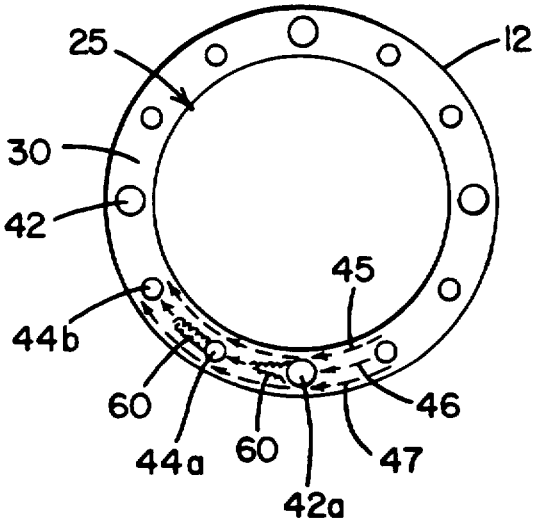
FIG. 4 is a schematic end elevation view of the furnace of the present invention showing schematically the wind mass pattern developed and shown in FIG. 3.

The heat transfer aspects of furnace 10 will now be explained with reference to the diagrammatic flows shown in the schematic illustrations of FIGS. 3 to 5. It is to be appreciated that the flows schematically correspond to what has been witnessed in streamer tests conducted on the invention. What is set forth below represents what is believed to occur to produce the flow streams discussed.

Figure 5:
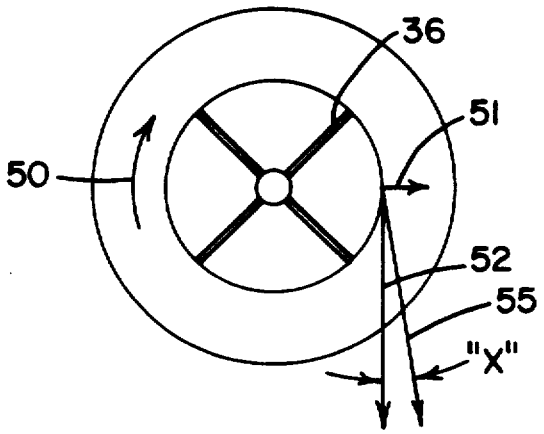
FIG. 5 is a further schematic end view showing schematically the formation of the swirling wind mass.

As best shown in FIG. 5, when paddle blades 36 rotate in the direction of arrow 50, the wind leaves blades 36 with a radial direction component indicated by arrow 51 and a tangential direction component indicated by arrow 52 to actually produce a wind vector 55 which is displaced from the tangential vector a slight angle designated as "X" which in practice is no more than about 8°. Since the wind vector 55 is almost tangential to blades 36, a swirl is created within fan chamber 26. If under-pressure opening 29 were blocked off, the wind would simply wipe the interior surfaces of cylindrical furnace section 12 in fan chamber 26. Because of the presence of under-pressure opening 29, furnace atmosphere is drawn into fan chamber 26 and the swirling mass of furnace atmosphere ejected from paddle blades 36 is displaced into heat treat chamber 27. Now it is important and critical to the working of the invention that space 30 be large enough, considering fan sizing, fan rotation and OD/ID spacing, so that a pressure drop or a significant pressure drop of the wind mass through space 30 does not occur, i.e. the space 30 is by definition a non-orificing annular space. If space 30 was shortened, a pressure would build in fan chamber 26 which would then function as a plenum chamber and the wind would be injected longitudinally into heat treat chamber 27 with a longitudinal velocity correlated to the pressure drop through the reduced space. More significantly, if annular space 30 was reduced in size to result in a pressure buildup in fan chamber 26, the wind mass would begin to straighten as it left the reduced annular space and the circumferential velocity of the swirl would be reduced. For example, if annular space 30 was reduced to the orifice size specified in Hemsath U.S. Pat. No. 4,789,333 to develop a high speed jet, the jet emanating from annular orifice space would be straight and without a swirl. It is also critical to the invention that furnace section 12 be cylindrical and smooth so that the wind mass can swirl about the section without breaking up or becoming turbulent. That is, cylindrical section 12 restrains the outward expansion of the swirl resulting from the slight radial component 51 and not only insures, but promotes the swirl configuration of the wind mass. In this connection, it is to be appreciated that if the radial component of the wind mass was significant, the fact the cylindrical furnace section 12 is cylindrical may, in itself, produce a swirl in the wind mass, but the exposed furnace insulation 17 would deteriorate, in time, under the impact. This does not occur in the present invention and the wind mass flow at the interface with insulation 17 is non-turbulent in both fan chamber 26 and heat treat chamber 27.

In the present invention and in contrast to the parent patent, tubular heating elements 42 extend into heat treat chamber 27 as opposed to burners located in fan chamber 26. Tubular heating elements 42 thus provide an extensive surface area to which the wind mass can be placed into heat transfer contact therewith. Importantly, the circumferential velocity of the wind mass developed by blades 36 is maintained high enough so that the swirl is not broken up or made turbulent by contact with tubular heating elements 42 or heat exchange tubes 44. That is, the high circumferential velocity of the swirl is providing wind impact at speeds approaching Reynolds numbers associated with jet velocities. Yet, because of the way the win mass is developed and because of the smoothness and shape of insulation 17 over cylindrical furnace section 12, the wind mass is not turbulent within cylindrical furnace section 12 adjacent insulation 17. This is schematically illustrated by wind streamers 45 which passes radially inwardly of tubular heating elements 42, wind streamers 47 which passes radially outwardly of tubular heating elements 49 and wind streamers 46 which impact tubular heating elements 42 and heat exchanger tubes 44. When the wind reflected by streamer 46 hits tubular heating elements 42 and heat exchanger tubes 44 it, of course, must break up. However, the speed of the wind reflected by streamers 45 and 47 is so high that the wind reflected by streamer 46 forms eddy flows indicated by reference numeral 60 downstream of tubular heating elements 42 and heat exchange tube 44 which dissipates to permit the wind deflected by streamer 46 to reform prior to impacting the next tubular heating element 42 or heat exchange tube 44. This reformation is shown as the wind circumferentially traverses tubular heating element 42*a*, then heat exchange tubes 44*a*, 44*b*, etc. in FIG. 4.

The wind enters heat treat chamber 27 as a swirling wind mass shaped as an annulus with a ring diameter approximately equal to the radial distance of non-orificing space 30. Because of the non-orificing characteristics of space 30 and because paddle blades 36 are used to develop the wind mass, there is little, if any, spiral or helical twist imparted to the wind mass as it travels the length of heat treat chamber 27. Within heat treat chamber 27 under-pressure opening 29 exerts a centripedal force on the wind mass annulus tending to strip inner portions of the annulus into work 15 as the wind mass longitudinally travels towards door 14. Because of the high circumferential speed of the wind mass in this invention, the wind mass that gets peeled off the inner portion of wind mass annulus at longitudinal distances indicated in FIG. 3 as L-1, L-2, L-3 is believed not that significant. A significant portion of the wind mass travels to door 14, shown as distance L-4, where it is then broken up, i.e. made turbulent, and drawn back at relatively low speed through work 15 into under-pressure openings 29. Thus, within heat transfer chamber 27 about its inner portions surrounding work 15 is low velocity, and turbulent wind which is returning to under-pressure opening 29. Heat transfer is effected between work 15 and this low velocity turbulent wind by the high volumetric wind flow which contacts work 15.

As thus far explained, a swirling wind mass in excellent heat transfer contact with longitudinally extending heat sinks and heat sources is developed. The wind mass is non-turbulent in its flow because of the smooth cylindrical shape of furnace section 12. The high circumferential velocity is sufficient to overcome any turbulence which would destroy its swirl characteristics by contact with the heat source and heat sink obstructions. The wind retains its aerodynamic swirl characteristics developed by paddle blades 36 because of non-orificing space 30. The under-pressure opening 29 causes the wind to be drawn, at low velocity, through work 15 back into fan chamber 26 and in the process thereof establish heat transfer contact with work 15. In this arrangement, high volumes of wind are circulated when compared to jet nozzles and the like of the prior art. Thus, the differential temperature between wind and work is not as great as that which would exist between wind and work in jet nozzles. However, the significantly greater volumetric flow produces good heat transfer from the swirl to the work and the circumferential velocity produces excellent heat transfer to the wind from the heat sink or heat source. At low temperature applications where heating occurs principally by convection, the arrangement described imparts good temperature uniformity to the work. Furthermore, and as noted at the outset, final high heat temperatures are achieved by radiation and the cylindrical shape of furnace section 12 and positioning of tubular heating elements 42 circumferentially about the work imparts uniform heat to work 15 at the upper temperature ranges which permits excellent temperature uniformity with work 15.

Furnace 10 is ideally suited for batch vacuum tempering operations. In this heat treat process, work 15 previously subjected to a heat treat process is transferred to furnace 10 for a vacuum tempering cycle. With door 14 sealed and furnace 10 at standard atmosphere pressure, the chamber is evacuated to approximately 50 microns (0.05 mm Hg). A nitrogen backflow (i.e nitrogen gas admitted through opening 40) takes place which raises the pressure to 0.5–2 psig positive pressure and tubular heating elements 42 are heated and fan motor 34 actuated to transfer the heat from tubular heating elements 42 to work 15 in the manner described. Work 15 approaches and is controlled at the desired tempering range of 800° to 1400° F. Furnace 10 is held at this soak temperature for a specified time. After the soak time is completed, tubular heating elements 42 are turned off and fan motor 34 is shut off for a short period of time. At that time, coolant is introduced into heat exchange tubes 44 and fan motor 34 activated to produce a specified cooling rate of work 15. Other vacuum heat treat processes can be accomplished and while the operation of furnace 10 has been described with respect to a vacuum process, it should be clear that furnace 10 can also operate as a standard atmosphere type furnace and it is a particular feature of the low cost construction of furnace 10 that the furnace can be economically manufactured and commercially sold for either or both applications.

ALTERNATIVE EMBODIMENT

Figure 6:
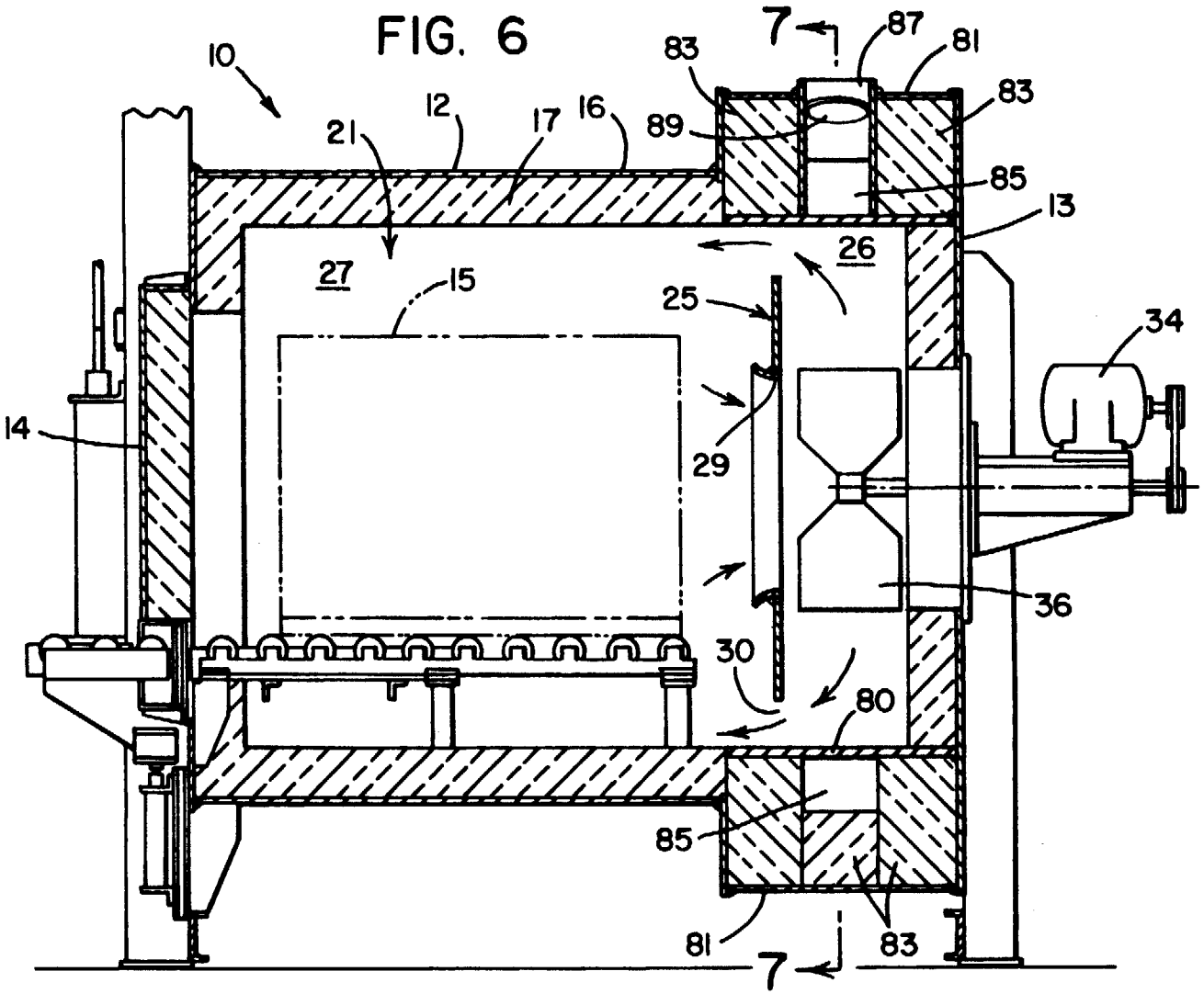
FIG. 6 is a sectioned, side elevation view of an alternative embodiment of the invention similar to the view shown in FIG. 2.
Figure 7:
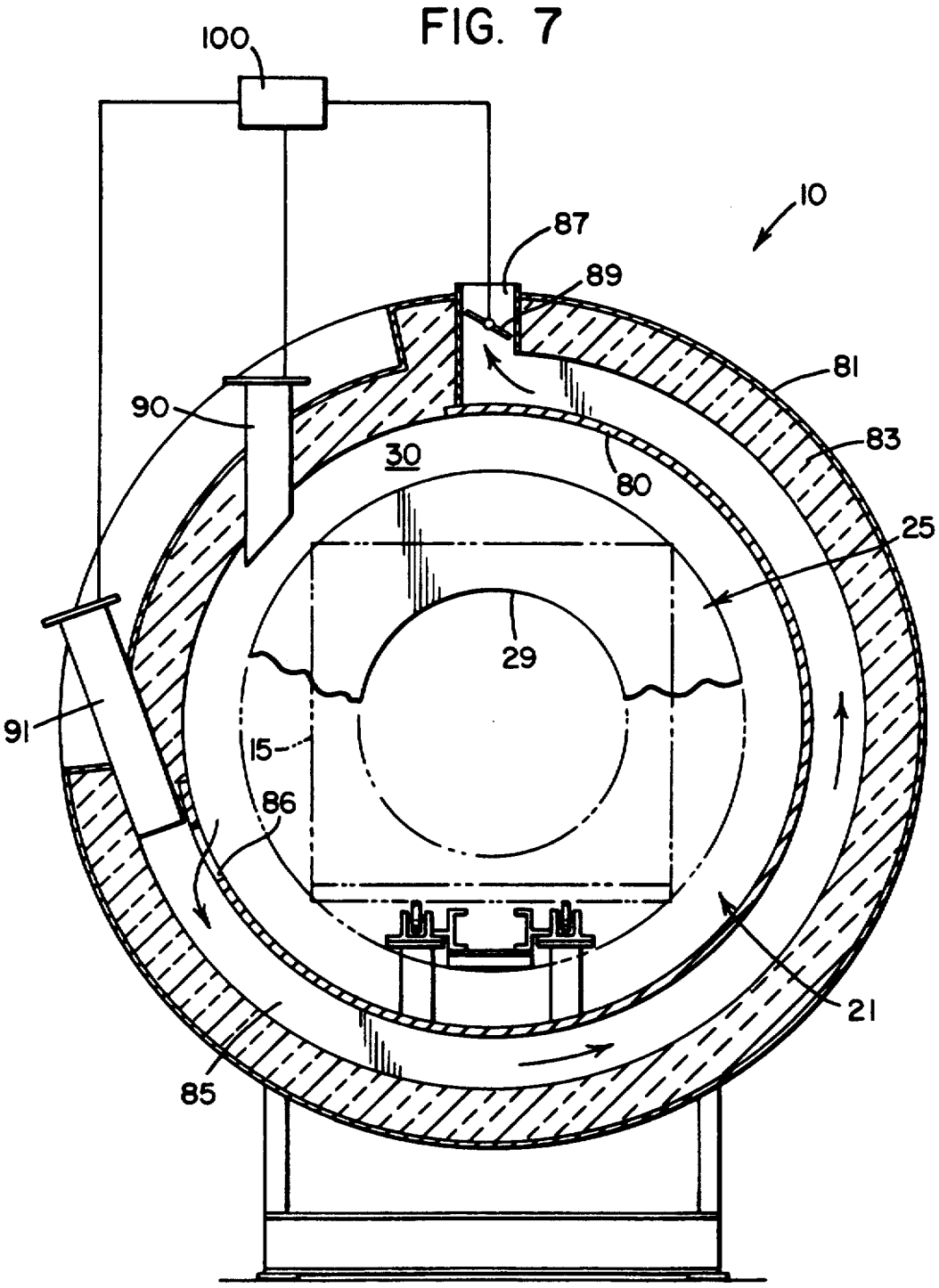
FIG. 7 is an end elevation view of the furnace shown in FIG. 6 taken along line 7—7 of FIG. 6.

FIGS. 6 and 7 illustrate an alternative embodiment of the invention and reference numerals used to describe furnace 10 in FIGS. 1 through 5 will likewise be used to describe the same components and parts of furnace 10 in FIGS. 6 and 7 where applicable. The construction of furnace 10 illustrated in FIGS. 6 and 7 bears a closer resemblance to the furnace described in the parent patent than the furnace construction shown in FIGS. 1 through 5. Since this invention is a continuation-in-part of the parent patent, the furnace construction shown in FIGS. 5 and 6 was chosen to better illustrate common elements of the inventions. As will be explained below, furnace 10 shown in FIGS. 1 through 5 can be modified to incorporate concepts shown in FIGS. 6 and 7.

Furnace 10 of FIGS. 6 and 7 was specifically developed in the course of heat treating powdered metal parts (and by analogy sintered metal parts). Powdered metal parts are conventionally heated in a positive pressure, standard atmosphere, batch furnace. When powdered metal parts are heated, heavy smoke containing hydrocarbons and volatiles from the resin binder is emitted. Heretofore, smoke was vented from the furnace to an afterburner or incinerator which would heat the volatiles in the presence of oxygen to a sufficiently high temperature to incinerate the fumes prior to discharging the cleansed fumes to the stack. While heat recovery is typically used in conjunction with the external afterburner or incinerator, the heat recovered is used only as a secondary heat source in the sense that combustion air to the furnace burner is preheated or boiler feed is heated, etc. Thus, additional energy in the form of fuel must be provided to the incinerator to heat furnace fume and this additional energy is only partially recovered as secondary heat. Furnace 10 of the alternative embodiment shown in FIGS. 6 and 7 provides for internal incineration of the fumes so that the furnace atmosphere can be directly exhausted to the stack without a separate afterburner or incinerator requiring its own source of fuel and the heat generated by the incineration of the fumes is directly used in the primary sense to heat work 15 in furnace 10.

Cylindrical furnace section 12 is modified over that portion of the furnace enclosure which substantially encompasses fan chamber 26. More specifically, and as best shown in FIG. 7, an inner steel casing 80 coaxial with the inside diametrical surface of insulation 17 for cylindrical furnace section 12 is provided. As shown in FIG. 7, inner casing 80 extends circumferentially through an included angle of about 270° around cylindrical furnace section 12 although inner casing 80 could extend almost completely around the interior of cylindrical furnace section 12 or could spiral about cylindrical furnace section 12. As shown in FIG. 6, inner casing 80 longitudinally extends a distance at least equal to the length of fan chamber 26 and in fact is slightly in excess thereof. Concentric with inner casing 80 and extending the length of inner casing 80 is an outer cylindrically shaped steel casing 81 which has a diameter greater than that of casing 16 for cylindrical furnace section 12. Inner casing 80 (and for an included angle of 90° the inside surface of cylindrical furnace section 12) and outer casing 81 define an annular casing space into which insulation 83 of the same type as that previously described is placed. Insulation 83 is affixed within the annular casing space either by packing or by studs and fasteners to form an annular groove or incineration track 85. As shown, incineration track 85 extends from inner casing 80 radially outwardly a fixed distance which is approximately half of the radial distance of the annular casing space between casings 80, 81 so that the wall thickness of the insulation can be made consistent throughout cylindrical furnace section 12. Incineration track 85 is thus in heat transfer contact with fan chamber 26 vis-a-vis inner casing 80.

An opening 86 is provided in inner casing 80 to place incineration track 85 into fluid communication with fan chamber 26. An outlet opening 87 is provided in outer casing 81 and insulation 83 to place incineration track 85 in fluid communication with ambient atmosphere vis-a-vis the conventional stack (not shown). A baffle 89 shown in outlet opening 87 but typically located in the duct leading to the stack controls the rate at which flue products leave outlet opening 87 and establishes (through back pressure) the positive pressure at which furnace 10 operates. As an aside, those skilled in the art will recognize that gas outlet opening 40 in furnace 10 shown in FIGS. 1 through 5 functions for the same purpose as that of baffle 89 and outlet opening 87 in furnace 10 shown in FIGS. 5 and 6.

In the alternative embodiment, a tangentially positioned gas fired burner 90 similar to that described in the parent patent is located within fan chamber 26 and directs its products of combustion generally tangential to the interior surface of fan chamber 26. In the parent patent, two burners were required whereas in the alternative embodiment only one burner 90 fires into fan chamber 26. A second burner defined as incineration track burner 91 is provided adjacent inlet opening 86 and is orientated to fire its products of combustion into incineration track 85. Both burners 90, 91 can be sized to have the same capacity, i.e. typically 0.50 mm Btu/hr but incineration track burner 91 is operated at a high percentage of excess air, i.e. 1000% excess air.

Operating fuel fired furnaces at excess air is well known to those skilled in the art and need not be explained herein. However, in order to appreciate the far reaching and diverse applications of the alternative embodiment, some discussion may be in order. Air and fuel are typically supplied to a gas fired burner at a stoichiometric ratio (i.e. for natural gas an air-fuel ratio of about 9:1) which assures complete combustion of the fuel. The hot gas or products of combustion produced by a burner fired stoichiometrically does not contain oxygen. It is known that when the burner is operated at excess air or air in excess of that required to produce a stoichiometric ratio of fuel and air, burner flame temperature increases slightly and oxygen appears in the products of combustion. Thus, operating incineration track burner 91 at very high percentages of excess air produces high levels of oxygen in the burner's product of combustion. This oxygen, at elevated temperature, will react with the volatiles in the smoke in an exothermic reaction to cause incineration thereof and thus generate additional heat which will further heat incineration track 85. Thus, inner casing 80 will be hotter than the wind mass in fan chamber 26 from heat in incineration track 85 and as the wind mass swirls about fan chamber 26, it will be heated from contact with inner casing 80. In fact, heat calculations indicate that the heat output produced by the two tangentially fired burners in the parent patent will not be greater than the heat output produced by furnace burner 90 plus incineration track burner 91 (which are identically sized in burner output) even though incineration track burner 91 does not fire its products of combustion directly into fan chamber 26. Next, it is to be appreciated that the fumes within incineration track 85 are not co-mingled with the furnace atmosphere in fan chamber 26 even though fluid communication is provided vis-a-vis incineration track opening 86. Incineration tack burner 91 is orientated to tangentially fire its products of combustion relative incineration track 85 just at the incineration track opening 86. However, it is contemplated that incineration track burner 91 could be positioned just upstream of incineration track opening 86. The point is that when incineration track burner 91 is fired tangentially, it will pull, suck, draw or aspirate furnace swirl mass through incineration track opening 86 into incineration track 85 but the burner's products of combustion will not enter into fan chamber 26. Thus, the fume composition in incineration track 85 has no effect on the composition of the furnace atmosphere. This feature significantly expands the various industrial applications which furnace 10 can perform. Specifically, it is known that certain materials such as scrap fiberglass waste and plastic coated wires can be thermally reclaimed and in the process thereof will emit hydrocarbons and volatiles which must be thermally disposed of. It is also known that certain hazardous and/or toxic material can be thermally disposed of. In both instances, thermal cleaning and/or destruction of hazardous wastes can be accomplished by heating the material in the absence of oxygen at controlled rates which would drive off hydrocarbons or volatiles which heretofore were incinerated by an external incinerator. An example of such process is set forth in Surface Combustion's U.S. Pat. Nos. 4,913,069 dated Apr. 13, 1990 and 4,924,785 dated May 15, 1990, incorporated herein by reference. Furnace 10 of the alternative embodiment can function to operate as a pyrolyzer furnace. First, burner 90 can be fired at various temperatures and can produce a "rich" gas to assure that work 15 (which now is a waste material or a non-metallic material such as scrap fiberglass) is heated in the absence of oxygen at controlled rates. Then incineration track burner 91 will incinerate the volatiles and because of its tangential firing and perhaps upstream position will not produce any gas mingling with the furnace atmosphere. Furnace 10 is thus not limited in application to heat treat processes.

The operation of alternative embodiment furnace 10 is believed obvious from the foregoing. The swirling wind mass within fan chamber 26 is developed as described above. The swirling wind mass does not short circuit from inlet opening 86 to exit opening 87 because inlet opening 86 is a discrete spot of finite size which will not trap a significant proportion of the swirling wind mass and baffle 89 regulates the rate at which the wind mass is tapped by incineration track 85. Further, the position of incineration track burner 91 and its firing velocity determines entrainment of furnace wind mass. Controller 100 regulates exhaust through baffle 89 and controls the firing rates of burners 90, 91 for temperature control of the process. Temperature is sensed through a centrally positioned thermocouple near work 15 (not shown) and a thermocouple in incineration track 85 (not shown) which are outputted to controller 100. As already noted, when the volatiles are combusted in incineration track 85, inner casing 80 is heated and the heat transferred to the wind mass swirling about inner casing 80.

For simplicity, incineration track 85 is shown as extending only about fan chamber 26. If furnace 10 as shown in FIGS. 1 through 6 were modified to include an incineration track, then incineration track 85 could be formed as a groove which would completely spiral around furnace section 12 and extend the length of radiant tube heaters 42. This would extend the residence time of the gases within incineration track 85 and assure that complete incineration of the gases occurred within furnace 10 and not outside the furnace in some insulated duct.

The invention has been described with reference to a preferred and alternative embodiment. Obviously, further modifications and alterations to the invention will become apparent to those skilled in the art upon reading and understanding the Description of the Invention set forth above. It is intended that all such modifications and alterations are included herein insofar as they come within the scope of the present invention.

Having thus defined the invention, it is claimed:

1. An industrial high temperature furnace for heating work at temperatures in excess of 1600° F. comprising:

a cylindrical, fiber insulated, furnace section, a sealable door at one axial end of said furnace section and an end plate at the opposite axial end thereof to define a closed end cylindrical chamber therein;

a circular fan plate concentrically positioned within said chamber dividing said chamber into a fan chamber extending between said circular plate and said end plate and a heat treat chamber extending between said circular plate and said door; said circular plate defining a non-orificing annular space between said circular plate's outer edge and the interior of said furnace section and providing fluid communication between said fan chamber and said heat heat treat chamber; said plate having a centrally positioned under-pressure opening extending therethrough also providing fluid communication between said heat treat chamber and said fan chamber;

heat means for heating said work by convection and radiation to temperatures of about 1400° F. and thereafter heating said work to higher temperatures principally by radiation, said heat means including a plurality of circumferentially spaced tubular elements longitudinally extending in an annular array from said end plate through said fan chamber into said heat treat chamber and passing through said annular space for establishing a temperature source which is at a temperature initially different than the temperature of the work within said heat treat chamber; and fan means centrally positioned within said fan chamber for directing furnace atmosphere in a direction perpendicular to the longitudinal center of said chamber and normal to said furnace section and swirling with high circumferential velocity at speeds sufficient to i) form a swirling annulus of wind, notwithstanding rapid, heat transfer impingement against said tubular elements, radially extending from the interior of said furnace to said plate's outer edge and ii) to prevent said under-pressure opening from stripping inner portions of said wind annulus into said work while said wind mass longitudinally moves gradually towards said door end while said under pressure zone causes said wind mass after dead ending against said door end to convectively contact said work in said heat treat chamber and to return to said fan chamber.

2. The furnace of claim 1 wherein said plurality of tubular elements are radiant tubes of the bayonet type and comprise four in number positioned top and bottom and on opposite sides of said work in equally spaced circumferential increments.

3. The furnace of claim 1 and said furnace includes a hearth for supporting work on a tray placed on said hearth, said tubular elements are spaced in equal circumferential increments about said work and said furnace to heat said work uniformly about its surfaces by radiation therefrom at temperatures in excess of 1400° F.

4. The furnace of claim 3 further including a second plurality of tubular elements interspersed within said first plurality of tubular elements, means for flowing a coolant through said second plurality of tubular elements and means for selectively actuating said first and second tube pluralities to heat and cool said work.

5. The furnace of claim 1 further including said furnace having a steel casing with fibrous insulation impaled thereon, means to supply a vacuum to said furnace so that said furnace operates as a vacuum furnace and means for supplying heat treat gases having a specific composition to said chamber.

* * * * *